US008743003B2

(12) United States Patent
De Lustrac et al.

(10) Patent No.: US 8,743,003 B2
(45) Date of Patent: Jun. 3, 2014

(54) STEERABLE ELECTRONIC MICROWAVE ANTENNA

(75) Inventors: André De Lustrac, Sceaux (FR); Abdelwaheb Ourir, Paris (FR); Shah Nawaz Burokur, Palaiseau (FR)

(73) Assignees: Universite Paris Sub (Paris II), Orsay (FR); Centre National de la Recherche Scientifique-CNRS-, Paris (FR); Universite Paris X, Nanterre (FR)

( * ) Notice: Subject to any disclaimer, the term of this patent is extended or adjusted under 35 U.S.C. 154(b) by 876 days.

(21) Appl. No.: 12/933,592

(22) PCT Filed: Mar. 18, 2008

(86) PCT No.: PCT/IB2008/052970

§ 371 (c)(1),
(2), (4) Date: Feb. 10, 2011

(87) PCT Pub. No.: WO2009/115870

PCT Pub. Date: Sep. 24, 2009

(65) Prior Publication Data

US 2011/0163930 A1 Jul. 7, 2011

(51) Int. Cl.
*H01Q 13/00* (2006.01)

(52) U.S. Cl.
USPC ..... 343/777; 343/700 MS; 343/846

(58) Field of Classification Search
USPC ..... 343/700 MS, 777, 846, 829, 769, 849, 343/848, 767, 770
See application file for complete search history.

(56) References Cited

U.S. PATENT DOCUMENTS

| | | | | |
|---|---|---|---|---|
| 4,937,585 | A * | 6/1990 | Shoemaker | 343/700 MS |
| 6,198,437 | B1 * | 3/2001 | Watson et al. | 343/700 MS |
| 2002/0167456 | A1 | 11/2002 | McKinzie et al. | |
| 2006/0114170 | A1 | 6/2006 | Sievenpiper | |

OTHER PUBLICATIONS

International Search Report for related international application No. PCT/IB2008/052970, report dated Sep. 12, 2008.

Ourir A, et al., "Bidimensional Phase-varying Metamaterial for steering beam antenna" Proceedings of the SPIE—The International Society for Optical Engineering, vol. 6581, May 4, 2007, p. 65810R-1-11, XP002505179 Prague, Czech Republic.

(Continued)

*Primary Examiner* — Douglas W Owens
*Assistant Examiner* — Jae Kim
(74) *Attorney, Agent, or Firm* — Miller, Matthias & Hull LLP

(57) ABSTRACT

A steerable microwave antenna includes a resonant cavity comprising a partially reflecting surface (PRS) formed of an array of transmitting-receiving cells ($CF_2$) each of which is adapted for control in transmissivity and directivity and a totally reflecting surface (TRS). A radiating element (RE) laid within the resonant cavity is provided in the vicinity of the totally reflecting surface (TRS) so as to generate microwaves. A circuit (Bx, By) for controlling transmissivity and directivity of each transmitting-receiving cell ($CF_2$) and of the partially reflecting surface (PRS) is further provided. Such an antenna can be implemented as an antenna for Wifi connections and cellular telephone handset.

18 Claims, 6 Drawing Sheets

(56) References Cited

OTHER PUBLICATIONS

Kante, et al., "Metamaterials for optical and radio communications" Comptes Rendus—Physique, Elsevier, Paris, FR, vol. 9, No. 1, Feb. 11, 2008, pp. 31-40, XP022524305 ISSN: 1631-0705.

Ourir a, et al., "Phase-varying metamaterial for compact steerable directive antennas" Electronics Letters, IEE Stevenage, GB, vol. 43, No. 9, Apr. 26, 2007, pp. 493-494, XP006028707 ISSN: 0013-5194.

Ourir A, et al., "Electronically reconfigurable metamaterial for compact directive cavity antennas" Electronics Letters, IEE Stevenage, GB, vol. 43, No. 13, Jun. 21, 2007, pp. 698-700, XP006029152 ISSN: 0013-5194.

Ourir A, et al. "Passive and active reconfigurable resonant metamaterial cavity for beam deflection" Antennas and Propagation International Symposium, 2007 IEEE, IEEE, Piscataway, NJ, USA, Jun. 1, 2007, pp. 4973-4976, XP031170305 ISBN: 978-14244-0877-1.

* cited by examiner

FIG. 1c
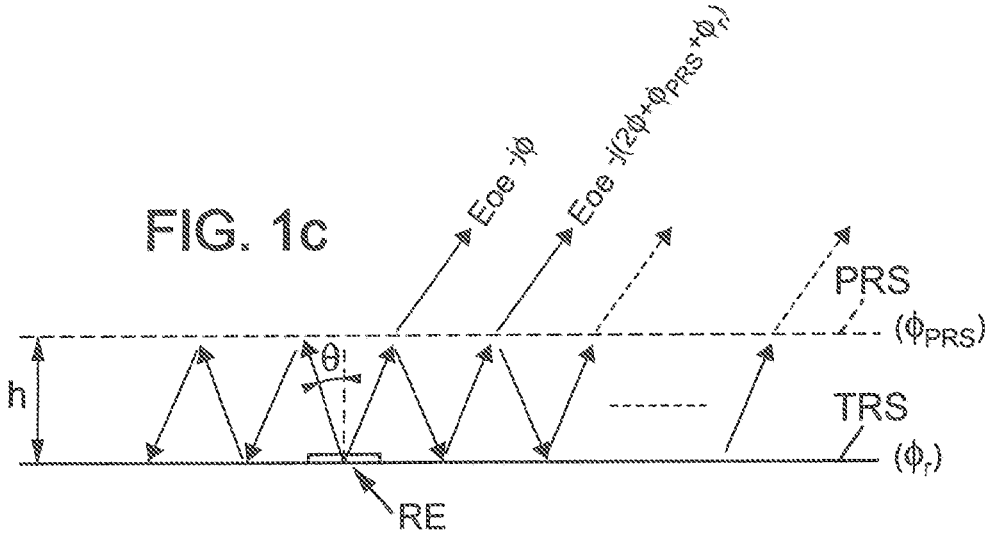
FIG. 2a
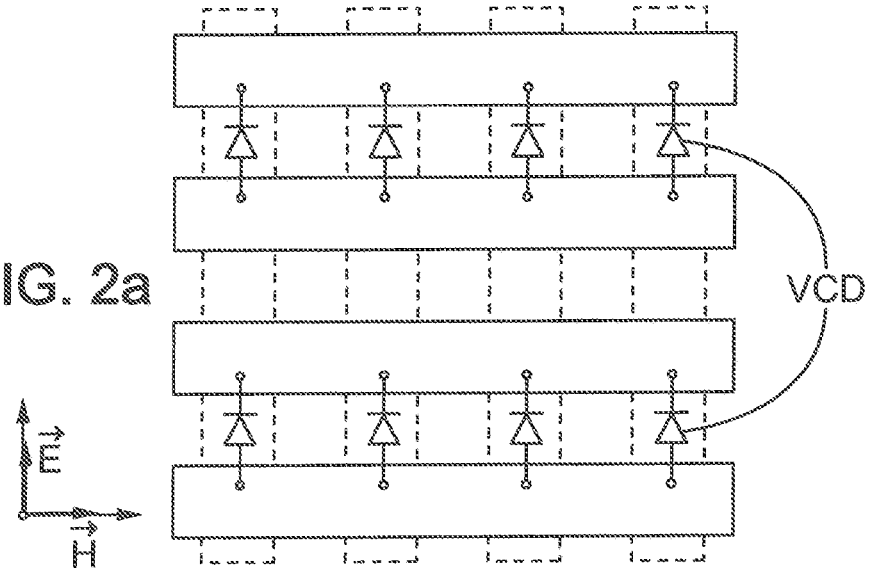
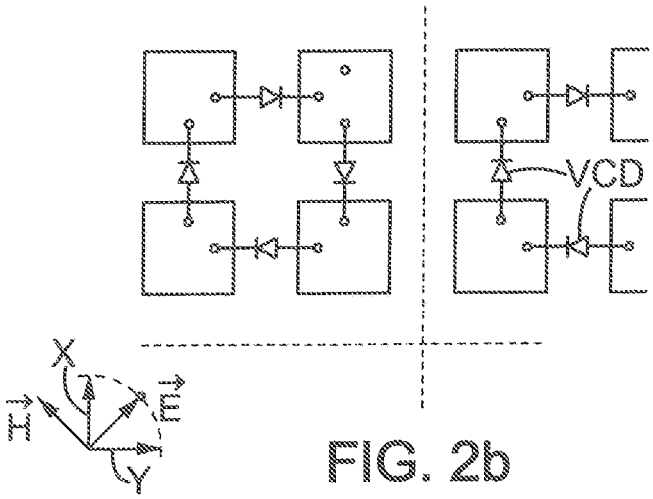
FIG. 2b

STEERABLE ELECTRONIC MICROWAVE ANTENNA

CROSS-REFERENCE TO RELATED APPLICATIONS

This application is a U.S. national stage filing under 35 USC §371 of International Patent Application No. PCT/IB2008/052970 filed on Mar. 18, 2008.

FIELD OF THE DISCLOSURE

The present invention relates to an improved technique for embodying a steerable electronic microwave antenna.

BACKGROUND OF THE DISCLOSURE

Steerable electronic microwave antennae have been used currently since many years.

Antennae of this type currently make use of a plurality of radiating elements arranged in an array of radiating elements the microwave input signal of which is amplitude and phase controlled, so as to finally control the direction of maximum transmission of the antenna.

Such a type of antenna is most difficult to design and to operate accurately, owing to its huge number of radiating elements and amplitude and phase controlling elements, which are necessary to make such a type of antenna operative.

More recently, many attempts have been made to embodying electronic microwave antennas in a much simpler way by using passive electronic elements arranged in an array of passive elements, each of these elements being adapted to radiate microwave in phase relationship.

US patent 2004/022 767 discloses a steerable antenna using an array of metallic patches on a substrate, with these patches being connected to the substrate thanks to metallic bored through holes and connected to each other by variable capacity diodes. Such an antenna makes use of surface waves which operate a radiating element laid above the substrate so as to radiate corresponding microwaves.

US patent 2007/0182639 discloses a tunable impedance surface and a fabricating method thereof. Such a surface operates substantially as a spatial filter.

US patent 2006/0114170 also discloses a tunable frequency selective surface using an array of variable capacity diodes interconnecting metallic wires. Such a surface operates also as a spatial filter adapted to filtering electromagnetic waves.

SUMMARY OF THE DISCLOSURE

An object of the present invention is therefore to provide a steerable electronic microwave antenna of very high performance that overcomes the above mentioned drawbacks of corresponding antennas of the prior art.

Another object of the present invention is furthermore to provide for a steerable electronic microwave antenna that is much easier to design and to operate than corresponding steerable electronic microwave antennas known from the prior art.

Another object of the present invention is therefore to provide a steerable electronic microwave antenna however mechanically and electronically much simpler to implement and more versatile in use than already known corresponding antennas.

The electronic microwave antenna which is the object of the invention includes at least a resonant cavity including a partially reflecting surface comprising an array of transmitting-receiving cells of this microwave, each transmitting-receiving cell of this array of transmitting-receiving cells being adapted for control in transmissivity and directivity and a totally reflecting surface facing the partially reflecting surface, with the partially and totally reflecting surface forming thus this resonant cavity.

It also includes a radiating element laid within the resonant cavity in the vicinity of the totally reflecting surface and adapted to generate the microwave.

A circuit for controlling transmissivity and directivity of each transmitting-receiving cell and thus of the partially reflecting surface is also provided.

More particularly, in accordance with the invention, the partially reflecting surface includes at least an inductive array formed by a pattern of regular reflecting zones of the microwave separated by regular dielectric zones and a capacitive array formed by a pattern of regular reflecting zones of the microwave separated by regular dielectric zones.

Two adjacent reflecting zones of the capacitive array are electrically connected through a variable capacity diode, with the reflecting and dielectric zones belonging to the inductive and capacitive array being superimposed to form the array of transmitting-receiving cells of the microwave.

In accordance with a further aspect of the present invention, for a given distance separating the totally reflecting surface and the internal face of the partially reflecting surface, the separating distance forms thus a reference dimension of the resonant cavity that verifies the relation:

$$h = \frac{\lambda}{4\pi}(\phi_{PRS} + \phi_r) \pm N\frac{\lambda}{2}$$

in which h designates the reference dimension, λ designates the microwave wavelength, N designates the resonant order mode of the resonant cavity, $\phi_{PRS}$ designates the phase shift introduced to the generated microwave directly reflected by the partially reflecting surface and $\phi_r$ designates the phase shift introduced to the generated microwave by the totally reflecting surface directly transmitting the generated microwave.

In accordance with another aspect of the present invention, the radiating element is adapted to generate a rectilinear microwave the electric field component of which is substantially parallel to one direction of the inductive array along which the pattern of regular reflecting zones of the inductive array is arranged and the magnetic field component of which is substantially parallel to another direction of the capacitive array, orthogonal to the one direction of the inductive array, along which the pattern of regular reflecting zones of the capacitive array is arranged. The one and another directions form thus reference directions.

In accordance with another aspect of the present invention, the radiating element is adapted to generate a circular polarized microwave the electric field component and the magnetic field component of which rotate in a plane which is substantially parallel to the pattern of regular reflecting zones of the inductive and capacitive array.

To this end, the partially reflecting surface includes a first array forming a capacitive array including a pattern of regular reflecting zones each formed by a square patch, each of said square patches lying aligned and regularly spaced apart from each other to form successive columns and rows spread along said first and second reference direction, two successive square patches aligned along said first and second direction being electrically connected through a variable capacity diode to form an electrical closed circuit including four adjacent square patches spread along said first and second reference direction, two adjacent successive electrical closed circuit being thus electrically separated from each other along said first and second reference direction and superimposed onto said first array along a third reference direction orthogonal to said first and second reference directions.

It also includes a second array adapted to form a selective inductive array along said first and or second reference direction, said second array including a first sub-array including a pattern of regular reflecting zones each formed by parallel metallic strips extending along said second reference direction over corresponding columns of square patches of said first array lying aligned along said same second reference direction, each parallel metallic strip of said first sub-array being electrically connected to one of two of the successive square patches underlying beneath each of said parallel metallic strips of said first array; and, superimposed onto said first sub-array along said third reference direction, a second sub-array including a pattern of regular reflecting zones each formed by parallel metallic strips extending along said first reference direction over corresponding rows of said square patches of said first array lying aligned along said same first reference direction and crossing thus said metallic strips of said first sub-array, each metallic strips of said second sub-array being electrically connected to one of two successive square patches underlying beneath each of said parallel metallic strips of said second sub-array and which are not electrically connected to said parallel metallic strips of said first array.

In accordance with another aspect of the present invention, the radiating element is frequency controlled with the radiating frequency of the generated microwave being adjusted in a frequency range lying within plus and minus 15% of the central frequency.

In accordance with a further aspect of the present invention, the radiating element consists of an array of elementary antennas with each of the elementary antennas forming this array being spaced apart from any other elementary antenna of a distance greater than $\lambda/4$, where $\lambda$ designates the mean microwave wavelength generated by each of the elementary antennas.

In accordance with a further aspect of the invention, the circuit for controlling transmissivity and directivity of each transmitting receiving cell and thus of the partially reflecting surface includes a resource for generating and delivering an adjustable bias voltage adapted to control the variable impedance of each of the transmitting-receiving cells.

In accordance with another aspect of the invention, the circuit for controlling transmissivity and directivity of each transmitting-receiving cell is programmable and adapted to generate and deliver at least one control bias voltage to each of the transmitting receiving cells.

In accordance with a particular mode of operation of the antenna of the invention, the at least one control bias voltage is a unique bias voltage for each address of all of the transmitting receiving cells, with this unique bias voltage being adapted to be varied within a given range of bias voltage values so as to adapt the central frequency of the generated microwave.

In accordance with another particular mode of operation of the antenna of the invention the unique bias voltage is further varied in accordance with the address along the first and/or second reference direction of each of the transmitting-receiving cells forming the partially reflecting surface. The microwave beam thus generated is thus deflected in azimuth and elevation direction in accordance with the variation of the bias voltage along the first and or second reference direction.

In accordance with a further particular mode of operation of the antenna of the invention, the positive and reverse bias potential are switched alternatively from the one to the other of the first and second arrays so as to allow the generated microwave beam to be deflected of a given angle within a plane parallel to a first reference plane including the first and the third directions and a plane parallel to a second reference plane including the second and third directions.

The antenna of the invention can be implemented using classical print board technology so as to embody useful Wifi antennas or cellular telephone handset antennas.

BRIEF DESCRIPTION OF THE DRAWINGS

The objects advantages and other particular features of the antenna of the invention will become more apparent upon reading of the following and unrestricted description of preferred embodiments thereof which are given by way of example only with reference to the accompanying drawings.

In the appended drawings:

FIG. 1*c* represents a diagram illustrating the mode of operation of the antenna of the invention as shown at FIG. 1*b;*

FIG. 2*a* represents a first embodiment of a capacitive array embodying a partially reflective surface forming a resonant cavity embodying the antenna of the invention;

FIG. 2*b* represents a second embodiment of a capacitive embodiment of a partially reflective surface forming a resonant cavity embodying the antenna of the invention;

DETAILED DESCRIPTION OF THE DISCLOSURE

Figure 1A:
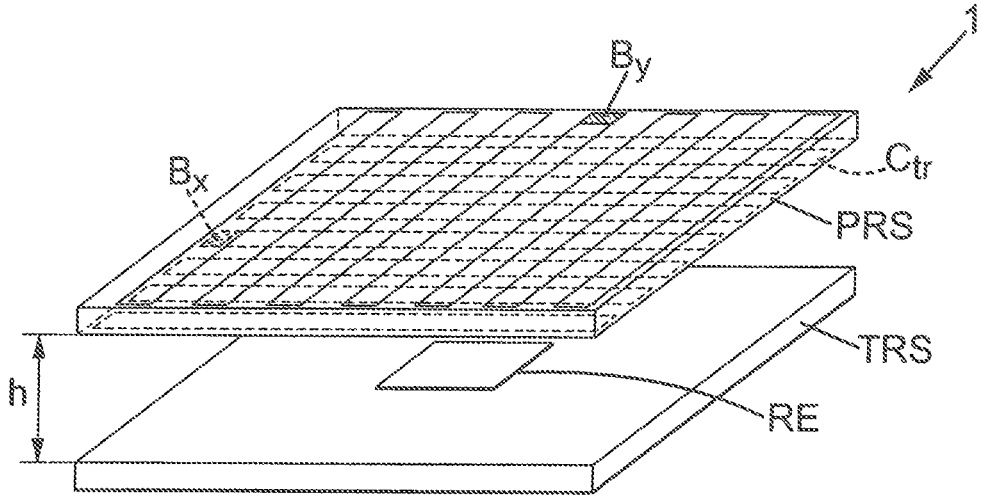
FIG. 1*a* is a perspective view of a first embodiment of a partially reflecting surface structure element of an antenna in accordance with the present invention.
Figure 1B:
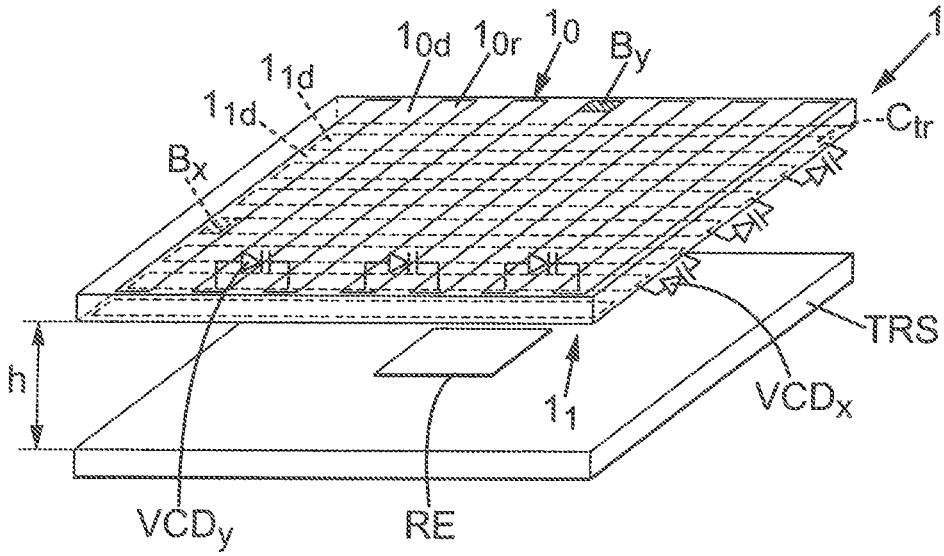
FIG. 1*b* is a perspective view of the first embodiment of an antenna in accordance with the present invention incorporating the structure element shown at FIG. 1*a;*

The antenna of the invention is now disclosed with reference to FIGS. 1*a*, 1*b* and 1*c*.

With reference to FIG. 1*a*, the steerable electronic microwave antenna of the invention comprises a resonant cavity referred to as 1. This resonant cavity includes a partially reflecting surface referred to as PRS with this partially reflecting surface being formed by an array of transmitting and receiving cells each of which is referred to as Ctr.

Each of the transmitting receiving cells Ctr is adapted for control in transmissivity and directivity.

The resonant cavity is also comprised of a totally (perfect) reflecting surface facing the partially reflecting surface PRS, with the partially reflecting surface PRS and the perfect reflecting surface referred to as TRS forming the resonant cavity 1.

A radiating element referred to as RE is located within the resonant cavity 1 laid on the vicinity of the totally reflecting surface TRS and adapted to generate and/or receive the microwave.

As further shown at FIG. 1*a* the steerable electronic microwave antenna of the invention is also provided with particular circuitry referred to as Bx and By which is adapted to control transmissivity and directivity of each transmitting receiving cell, and, consequently of the partially reflecting surface PRS.

A particular embodiment of the partially reflecting surface PRS is now disclosed in more detail with reference to FIG. 1*b*.

As shown at FIG. 1*b*, the partially reflecting surface PRS is formed with an inductive array, referred to as $\mathbf{1}_0$, which is formed by a pattern of regular reflecting zones of the microwave separated by regular dielectric zones. At FIG. 1*b* the reflecting zones of the inductive array are referred to as $\mathbf{1}_{0r}$ and the electric zones are referred to as $\mathbf{1}_{0d}$.

The partially reflecting surface PRS comprises also a capacitive array referred to as $\mathbf{1}_1$ which is in turn formed by a pattern of regular reflecting zones of the microwave separated by regular dielectric zones. At FIG. 1*b* the reflecting zones of the capacitive array $\mathbf{1}_1$ are referred to as $l_{1r}$ and the electric zones are referred to as $\mathbf{1}_{1d}$.

As it is also shown at FIG. 1*b*, the reflecting zones $\mathbf{1}_{1r}$ of the capacitive array $\mathbf{1}_1$ are electrically connected through variable capacity diodes which are referred to as VCDx and VCDy with reference to two particular dimensions designated as X and Y of the partially reflecting surface.

The reflecting and dielectric zones belonging to inductive and capacitive array form thus the array of transmitting receiving cells of the microwave.

In FIGS. 1*a* and 1*b* the totally reflecting surface TRS and the external face of the partially reflecting surface PRS forming the resonant cavity 1 are separated from each other of a distance designated as h which is a reference dimension of the resonant cavity 1.

The above-mentioned reference dimension is an essential parameter of the resonant cavity 1 embodying the antenna which is the object of the invention.

More particularly, this reference dimension verifies the relation:

$$h = \frac{\lambda}{4\pi}(\phi_{PRS} + \phi_r) \pm N\frac{\lambda}{2}$$

In the preceding relation h designates the reference dimension of the resonant cavity 1;

$\lambda$ designates the wavelengths of the microwave;

N designates the resonant order mode of the resonant cavity 1;

$\phi_{PRS}$ designates the phase shift introduced to the generated microwave directly reflected by the partially reflecting surface PRS;

$\phi_r$ designates the phase shift introduced to the generated microwave by the totally reflecting surface TRS directly transmitting the generated microwave.

The mode of operation of the antenna which is the object of the invention as illustrated in FIGS. 1*a* and 1*b* is now disclosed with reference to FIG. 1*c*.

The steerable electronic microwave antenna which is the object of the invention makes use of a Fabry-Perot resonant cavity as shown at FIGS. 1*a* and 1*b*. Such a resonant cavity is based on the working principle of a Trentini's antenna. It substantially consists of the partially reflecting surface PRS and the perfect reflecting surface TRS.

The resonance condition for the resonant cavity 1 is given by the preceding relation.

So far the phase shift $\phi_{PRS}$ which is introduced by the partially reflecting surface PRS in transmitting the microwave is adapted to compensate for the corresponding phase shift $\phi_r$ introduced by the totally reflecting surface TRS as shown at FIG. 1*c*, the reference distance h is thus very close to the zero value. In the case of a Trentini's antenna $h=\lambda/2$. However in the antenna which is the object of the invention and the resonant cavity 1 thereof the reference dimension h is much lower than $\lambda/2$, $h \ll \lambda/2$.

The partially reflecting surface and the totally reflecting surface are said to embody metamaterials.

The first one referred to as the partially reflecting surface is a composite one formed by the inductive grid $\mathbf{1}_0$ and the capacitive grid $\mathbf{1}_1$.

The second one is formed by a dielectric board to which a metallic ground is plated, forming the totally reflecting surface TRS.

The two grids are resonant but their reflection phases vary with frequency.

To achieve a directive antenna of low thickness, the sum of the phase shifts $\phi_{PRS}$ and $\phi_r$ must be close to zero. Such a condition is achieved at about 10 GHz. However this sum must not be null since the thickness of the dielectric board of the partially reflecting surface and the totally reflecting surface must be considered.

FIG. 1*c* shows that the microwave radiations come out from the partially reflecting surface PRS with a phase variation between each other. Actually, the partially reflecting surface PRS behaves like an array of micro-antennas, i.e. like an array of transmitting-receiving cells emitting or receiving in phase in a specified direction as shown as FIG. 1*a*. So far the phases of this array of micro cells can be adjusted, then the direction of the radiated beam of the antenna can be thus controlled.

Several embodiments of the antenna of the invention are now disclosed with reference to FIGS. 2*a* and 2*b*.

With reference to FIG. 2*a*, it is thus considered that the radiating element RE generates a rectilinear polarized microwave the electric field component E of which is substantially parallel to one direction of the inductive array along which the pattern of regular reflecting zones of this array is arranged while the magnetic field component H of this microwave is however substantially parallel to another direction of the capacitive array, the one and the other direction referred to as X and Y being substantially perpendicular to each other.

As shown at FIG. 2*a*, the above-mentioned reflecting zones are shown as being embodied as metallic strips which are parallel to each other, with the inductive array being represented in phantom lines and the capacitive array being represented in solid line. The two above-mentioned directions X and Y are thus referred to as reference directions.

As shown in FIG. 2*a*, the above-mentioned pattern of regular reflecting zone of the inductive array consists of a set of parallel rectangular metallic zones forming the metallic strips which are laid on to the dielectric substrate along the first reference direction X and the pattern of regular reflecting zones of the capacitive array consists of another set of regular metallic zones forming the metallic strips which are laid on to the opposite face of the dielectric substrate along the second reference direction Y.

FIG. 2*b* refers to another embodiment of the antenna of the invention particularly adapted to a radiating element generating a circular polarized microwave the electric field component E and the magnetic field component H of which rotate in a plane which is substantially parallel to the pattern of regular reflecting zones of the inductive and capacitive array.

As shown at FIG. 2*b* for the capacitive array, the pattern of regular reflecting zones of the capacitive array $\mathbf{1}_1$ and of the inductive array $\mathbf{1}_0$ consist of metallic capacitive and inductive zone respectively lying aligned along the first X and second Y reference directions. As clearly shown at FIG. 2*b* however each metallic inductive and capacitive zones consists of a square metallic patch with any one of the other capacitive patches facing one of the inductive patches. Each metallic capacitive patch is connected to any other adjacent square metallic capacitive patch through a variable capacity diode VCD. However, since any given capacitive patch faces another corresponding inductive patch, inductive patches are not shown at FIG. 2*b*.

Figure 3:
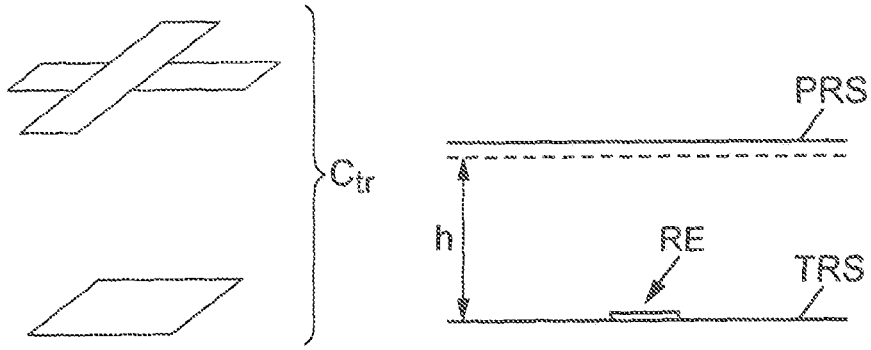
FIG. 3 represents as an example the structure of a transmitting-receiving cell embodying an antenna of the invention.

A transmitting-receiving cell is also shown at FIG. 3 with this cell corresponding to the embodiment shown at FIG. 2*a*. Each cell is considered to consist of one strip of the inductive array $\mathbf{1}_0$ crossing one strip of the capacitive array $\mathbf{1}_1$ together with corresponding part of the totally reflective surface TRS facing the crossing zone of the strips forming the inductive and the capacity array.

Figure 4A:
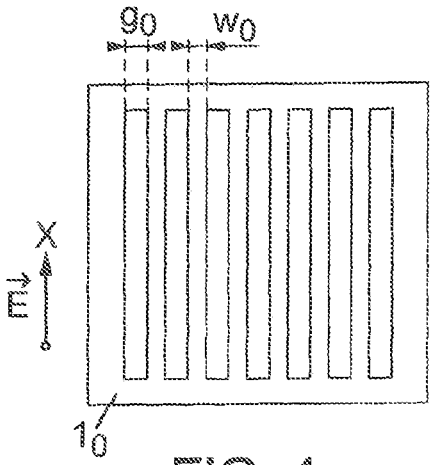
FIG. 4*a* is a front view of an inductive array embodying a partially reflecting surface of the antenna of the invention.
Figure 4B:
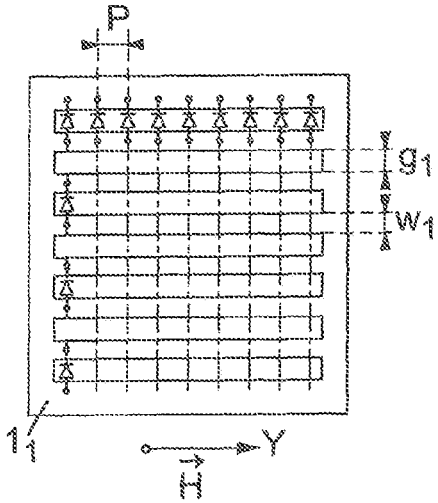
FIG. 4*b* is a front view of a capacitive array embodying a partially reflecting surface of the antenna of the invention which can preferably be used in connection with the inductive array as shown at FIG. 4*a;*

A particular embodiment of the antenna of the invention is shown at FIGS. 4*a* and 4*b*.

FIG. 4*a* represents a front view of the inductive array $\mathbf{1}_0$ with metallic strips of width $w_0$ lying aligned along the first direction X and spaced apart of $g_0$ along the second reference direction Y.

FIG. 4*b* represents a front view of the capacitive array $\mathbf{1}_1$ with metallic strips lying aligned along the second direction Y and connected through variable capacity diodes spaced from each other with a distance p=6 mm.

Figure 4C:
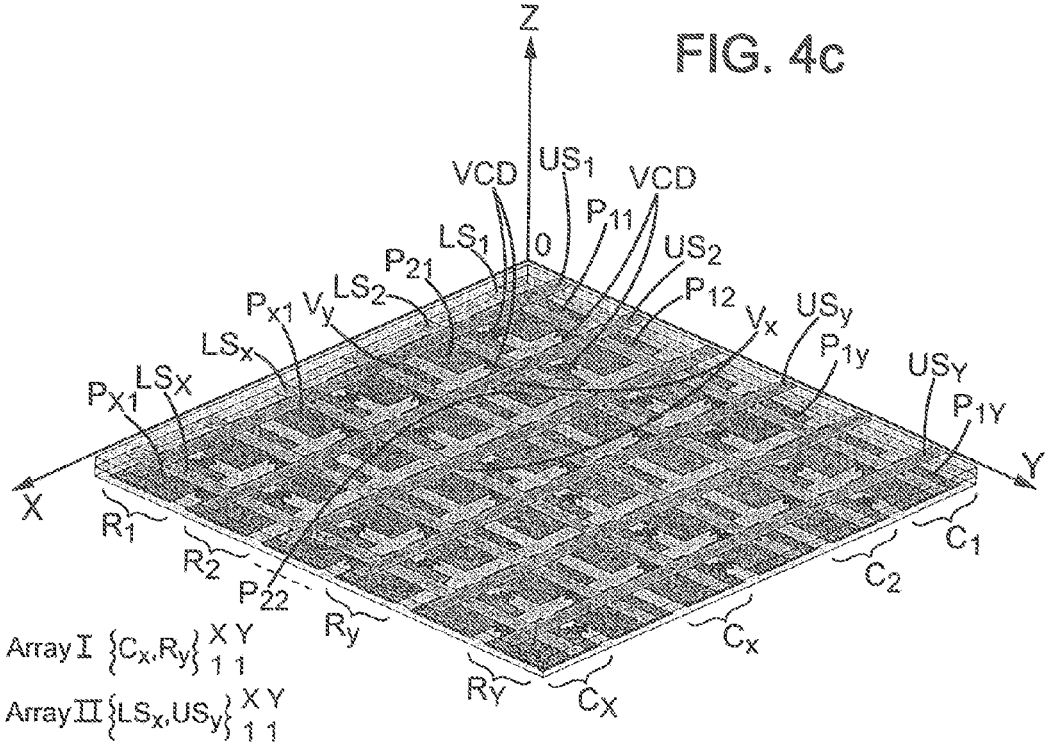
FIG. 4*c* represents a preferred embodiment of the partially reflecting surface specially adapted to allow a two dimensional steering of the antenna microwave beam in accordance with the present invention, the implementation mode of which is substantially simplified and made easy to carry out having regard to the variable capacity diodes controlling.

The partially reflecting surface PRS as shown at FIGS. 4*b* and 4*c* is implemented onto a FR3-epoxy substrate 1.4 mm thick; $\in r=3.9$ and tan $\delta=0.00197$. It comprised 12×12 transmitting-receiving cells regularly distributed onto the mm×72 mm substrate of printed circuit board. The variable capacity diodes VCD were welded and spaced apart from one another with a distance p=6 mm. The metallic strips forming the capacitive array $\mathbf{1}_1$ were of width $w_1$=1 mm and spaced apart from each other with a pitch $g_1$=2 mm.

The inductive array $\mathbf{1}_0$ was formed with metallic strips of width $w_0$=3 mm and spaced apart from each other of $g_0$=3 mm.

The reference distance h separating the partially reflecting surface from the totally reflecting surface TRS was h=3 mm.

The radiating element RE was formed of a square patch antenna 9×9 $mm^2$ laid onto a totally reflecting surface TRS made of a same substrate of printed circuit board as that embodying the partially reflecting surface PRS.

Another particular embodiment of the antenna of the invention is shown at FIG. 4*c*.

As shown at FIG. 4*c*, it is considered an antenna in accordance with the present invention in which the radiating element RE generates a circular polarized microwave having an electrical field component E and a magnetic field component H rotating in a plane which is parallel to the pattern of regular reflecting zones of the inductive and capacitive array. The antenna of the invention shown at FIG. 4*c* may also be operative using microwaves polarized in orthogonal rectilinear direction.

In this situation, the partially reflecting surface PRS includes a first array I forming a capacitive array including a pattern of rectangular reflecting zones each formed by a square patch. The square patches, each referred to as $P_{xy}$ at FIG. 4*c* are lying aligned and regularly spaced apart from each other to form successive columns and rows of patches which are spread along the first X and the second Y reference directions.

At FIG. 4*c*, the square patches $P_{xy}$ are referred to with their first and second index referring to their corresponding rank or address along the first X and second Y direction respectively and the columns and rows of patches are referred to as $C_x$ and $R_y$ with their index referring to their corresponding rank or address along the same first X and second Y direction respectively.

The first array I shown at FIG. 4*c* is thus formed by a set of rows and columns of square patches denoted:

$$\{C_x,R_y\}_{1X}^{1Y} \qquad \text{Array I}$$

As shown at FIG. 4*c*, two successive square patches which are aligned along the first X and second Y directions, as an example the square patches $P_{11}$, $P_{21}$, which are aligned along the first reference direction X, and the square patches $P_{11}$, $P_{12}$ which are aligned along the second reference direction X and the square patches $P_{11}$, $P_{12}$ which are aligned along the second reference direction Y are electrically connected through a variable capacity diode VCD to form an electrical closed circuit including four adjacent square patches spread along the first X and second Y reference directions.

At FIG. 4*c*, the square patches $P_{11}$, $P_{12}$, $P_{21}$, $P_{22}$ form together an electrical closed circuit.

However, two adjacent electrical closed circuit are electrically separated from each other along the first X and the second Y reference direction.

As also shown at FIG. 4*c*, the partially reflecting surface PRS further includes a second array, denoted Array II, which is adapted to form a selective inductive array along the first X and/or the second Y direction. The second array Array II is superimposed onto the first array, Array I, along a third reference direction Z orthogonal to the first X and second Y reference directions.

Preferably the second array, Array II, is formed with a first sub-array made of a pattern of regular reflecting zones each formed by parallel metallic strips extending along the second reference direction Y.

At FIG. 4*c*, each metallic strip belonging to the first sub-array is denoted $LS_x$ with its index referring to its corresponding rank or address along the first direction X.

As also shown at FIG. 4*c*, each parallel metallic strips $LS_x$ of the first sub-array is electrically connected to one of two of the successive square patches belonging to corresponding column $C_X$ and underlying beneath the corresponding parallel metallic strips $LS_x$ of the first sub-array. However, the electrical connections of two successive metallic strips $LS_x$, $LS_{x+1}$ of the first sub-array to a corresponding square patch $P_{xy}$ of corresponding column $C_x$ of the first array are shifted to form staggered rows with respect to each other. In other words, the electrical connexion of two successive metallic strips $LS_x$ of the first array to a given electrical closed circuit is executed to the square patches lying at the opposite diagonal apexes of this electrical closed circuit. See particularly at FIG. 4*c* in which strips $LS_1$ and $LS_2$ of the first sub-array are connected to square patches $P_{12}$ and $P_{21}$ respectively.

Thus, as shown at FIG. 4*c*, the second array Array II includes a second sub-array which is formed by a pattern of regular reflecting zones each formed by parallel metallic strips extending along the first reference direction X over corresponding rows of square patches of the first array Array I and lying aligned along the same first reference direction.

At FIG. 4*c*, the parallel metallic strips of the second sub-array are denoted $US_y$ each of them being superimposed onto corresponding row $R_y$ of square patches $P_{xy}$. Each parallel metallic strip $US_y$ of the second sub-array crosses successive parallel metallic strips $LS_x$ of the first sub-array over a corresponding square patch $P_{xy}$ belonging to the first array, Array I.

At FIG. 4*c*, the second array is denoted:

$$\{LS_x, US_y\}_{11}^{XY}. \qquad \text{Array II}$$

In the same way as per the first sub-array, each metallic strip $US_y$ of the second sub-array is electrically connected to one of two successive square patches underlying beneath each of these parallel metallic strips $US_y$ of the second sub-array and which are not electrically connected to the parallel metallic strip $LS_x$ of the first sub-array. As an example, as shown at FIG. 4*c*, metallic strip $US_1$ of second sub-array is connected to corresponding patches $P_{11}$, $P_{31}$ . . . successively.

Like per the first sub-array, the electrical connections of two successive metallic strip $US_y$ of the second sub-array to corresponding underlying square patches of the first sub-array are thus located in staggered rows with respect to each other. In other words, the electrical connection of two successive metallic strips $US_y$ of the second sub-array to a given electrical closed circuit is executed to the square patches lying at the opposite diagonal apexes of this electrical closed circuit. See particularly at FIG. 4*c* in which strips $US_1$ and $US_2$ of the second sub-array are connected to square patches $P_{11}$ and $P_{22}$ respectively.

In operation, either of the first and/or second sub-array of second array II may be rendered inductive with respect to the first array, Array I, which is always maintained capacitive.

The mode of operation of an antenna in accordance with the object of the invention embodying a partially reflecting surface PRS as shown at FIG. 4*c* is thus as follows:

a) first array, Array I, is always maintained as a capacitive array;

b) metallic strips $US_y$ of the second sub-array are rendered inductive by setting them to a reference or ground potential and applying a bias potential $\Delta V$ to each of the metallic strips $LS_x$ of the first sub-array with respect to this reference or ground potential. This situation allows deflecting the generated microwave beam within a plane parallel to the plane parallel to the reference plane OXZ including the first X and third Z reference directions.

c) Metallic strips $LS_x$ of the first sub-array are rendered inductive by setting them to the reference or ground potential and applying a bias potential $\Delta V'$ to each of the metallic strips $US_y$ of the second sub-array with respect to a reference or ground potential. This situation allows deflecting the generated microwave beam within a plane parallel to the reference plane OYZ including the second Y and third Z reference directions.

Clearly, rendering the first and second sub-array inductive may be timely and/or sequentially switched so as to allow a full steering of the generated microwave beam to be conducted in azimuth and/or elevation direction.

In the embodiment of the partially reflective surface shown at FIG. 4*c* each transmitting-receiving cell consists of an electrical closed circuit including four adjacent square patches $P_{xy}$ and connecting variable capacity diodes VCD, together with crossing adjacent metallic strips superimposed onto corresponding square patches and electrical connections $V_x$ and $V_y$, as shown as a non limitative example at FIG. 4*c* with square patches $P_{11}$, $P_{12}$, $P_{21}$, $P_{22}$, metallic strips $LS_1$, $LS_2$ and $US_1$, $US_2$.

The partially reflecting surface PRS shown at FIG. 4*c* may be embodied using stacked printed circuit boards or multilayers circuit board, with the electrical connections $V_x$ and $V_y$ being formed by electrical vias, as fully known in the corresponding art.

In accordance with a further aspect of the antenna of the invention, the radiating element RE is frequency controlled. The radiating frequency of the radiated microwave may be adjusted in a frequency range lying within + and −15 percent of a central frequency.

Figure 5A:
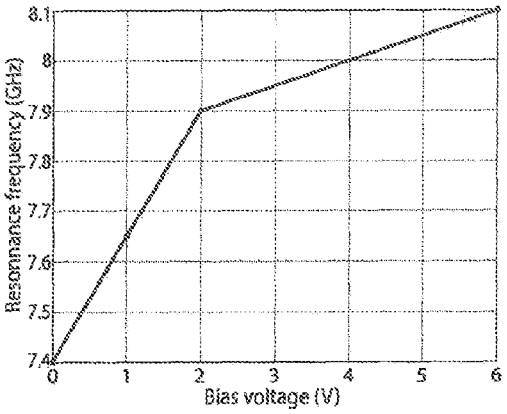
FIG. 5*a* represents a diagram of the variation of the resonant frequency of the resonant cavity for different bias voltages which are applied, with the resonant frequency expressed in GHz being plotted over the bias voltage expressed in volts.
Figure 5B:
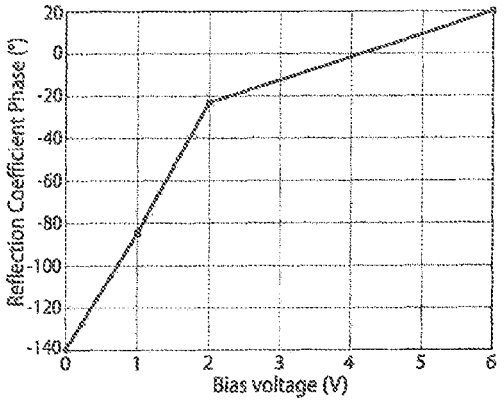
FIG. 5*b* represents a diagram of the variation of the reflection coefficient phase of the partially reflecting surface as a function of the variable capacity diodes bias voltage for a resonant frequency of the resonant cavity established to 8 Ghz, with the reflection coefficient phase being expressed in positive or negative values and the bias voltage being expressed in volts.

To this end, FIGS. 5*a* and 5*b* represent the resonant frequency of the resonant cavity 1 of the antenna of the invention as a function of the bias voltage, particularly the bias voltage applied between the internal face of the partially reflecting surface forming the resonant cavity 1 and the radiating element RE. As it can be seen at FIG. 5*a*, the diagram representing the resonant frequency of the antenna of the invention as a function of the bias voltage expressed in Volts is substantially linear with a first slope from 0V to 2V and then substantially linear from 2V to about 6V with a lower slope than the first one.

Figure 6C:
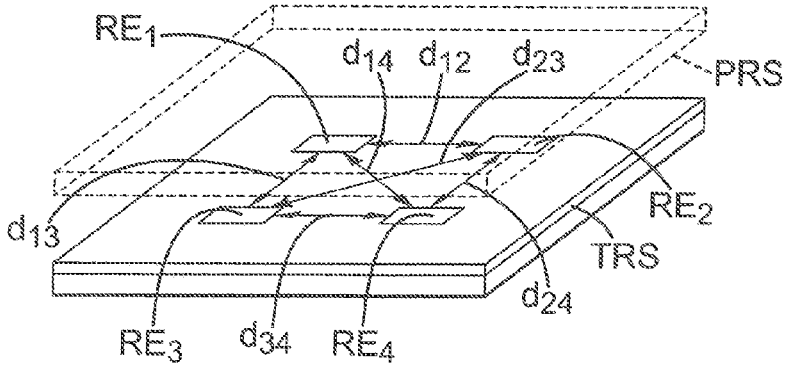
FIG. 6*c* represents a further embodiment of the antenna of the invention in which the radiating element is formed by an array of elementary antennas.
Figure 6A:
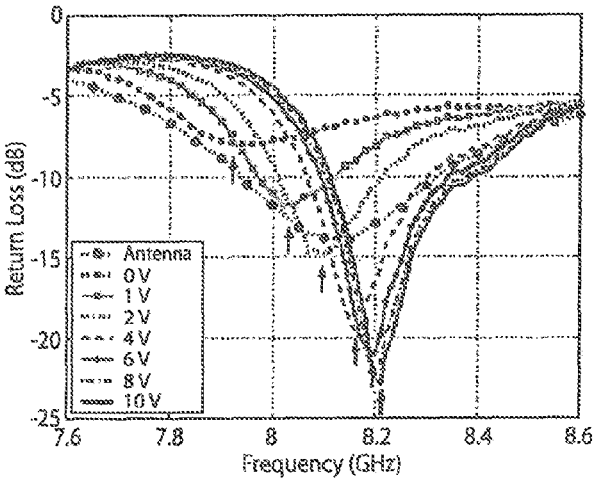
FIG. 6*a* represents the measured resonant frequency of the resonant cavity for different values of the bias voltage applied to the variable capacity diodes, with the resonance amplitude being expressed in Return Loss in dB and the frequency being expressed in GHz.

FIG. 6*a* shows as an example the return loss expressed in dB as a function of the resonant frequency of the antenna of the invention. As can be seen at FIG. 6*a*, the minimum insertion loss refers to a maximum amplitude of the microwave signal transmitted or received by the antenna which is the object of the invention.

Figure 6B:
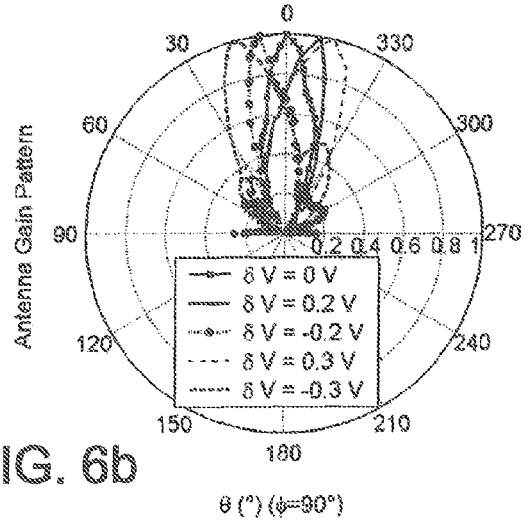
FIG. 6*b* represents a gain pattern diagram of the antenna of the invention showing the electronic control of the antenna beam steering for an antenna in accordance with the invention including an inductive and a capacitive array as shown at FIGS. 4*a*, 4*b* and 4*c* respectively.

FIG. 6*b* represents a diagram, a radiation pattern, of the antenna gain versus direction of the antenna of the invention for voltage values steps applied to the capacitive array and particularly to successive variable capacity diodes along the corresponding first direction X as shown at FIG. 4*c*, at FIGS. 2*a* or 3*a* and 3*b* as an example.

The antenna which is the object of the present invention is now disclosed with reference to FIG. 6*c*.

In a general sense, the radiating element RE is not limited to a patch antenna as shown as an example at FIG. 1*b*.

More particularly, the radiating element RE may consist of a patch antenna as already disclosed, a dipole, or more generally of an array of elementary antennas.

As shown at FIG. 6*c*, the radiating element is an array of elementary antennas each elementary antenna denoted $RE_1$ to $RE_4$ forming this array being spaced apart from any other elementary antenna of a distance greater than $\lambda/4$ where $\lambda$ designates the mean microwave wavelength generated by each of the elementary antennas.

As clearly shown at FIG. 6*c*, the distances $d_{12}$ to $d_{34}$ separating each elementary antenna are each greater than $\lambda/4$. Embodying the radiating element as an array of elementary antennas allows to improve the mode of operation of the steerable antenna which is the object of the present invention to control directivity of the microwave beam.

Figure 7:
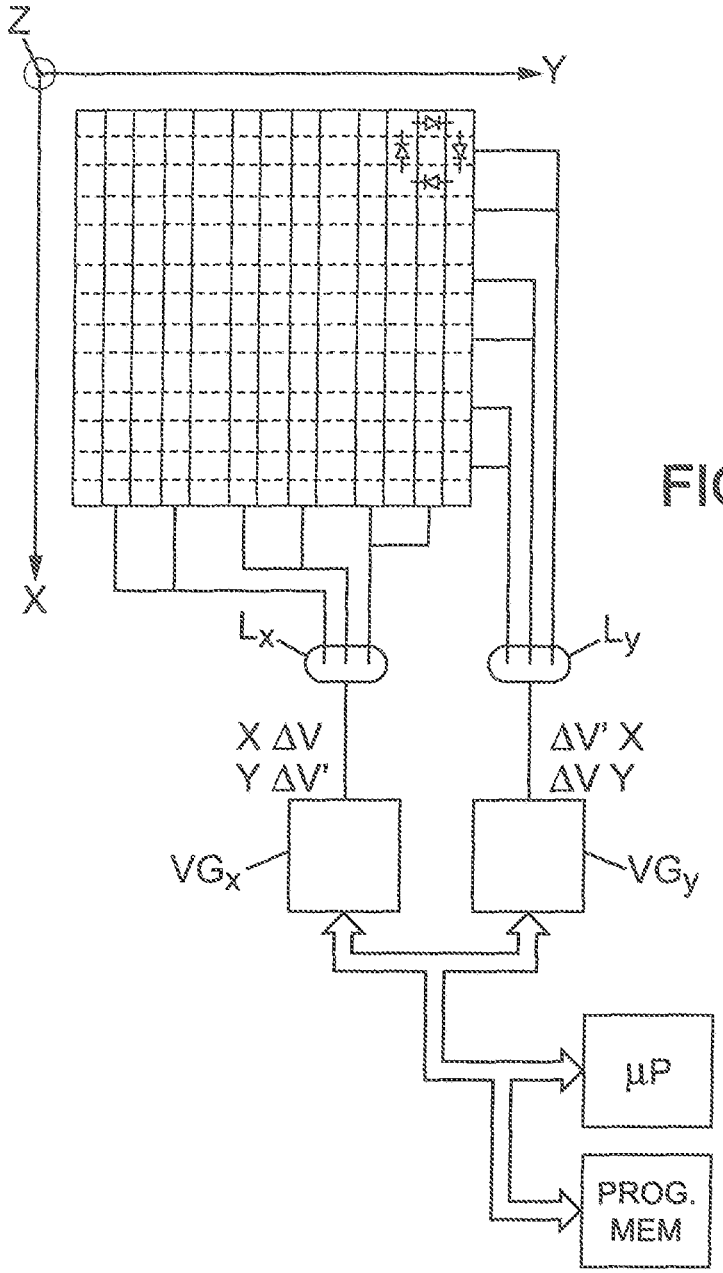
FIG. 7 represents a particular embodiment of circuitry specially adapted to control transmissivity and directivity of each transmitting-receiving cell and of the antenna which is the object of the invention.

A further embodiment of the antenna of the invention particularly of its circuitry specially adapted to control transmissivity and directivity of each transmitting-receiving cell is now disclosed with reference to FIG. 7.

In accordance with one of the outer most feature of interest of the antenna of the invention, a circuitry particularly adapted to generate, deliver and adjust a bias voltage adapted to control the variable impedance of each of the transmitting-receiving cells is provided.

More particularly, the circuitry is comprised of a bias circuit for parallel and/or individually controlling the bias potential delivered to each variable capacity diode VCD included in each of the transmitting receiving cells.

In a preferred embodiment of the antenna which is the object of the invention, this circuitry is programmable and adapted to generate and deliver at least one controlled bias potential to each of the transmitting receiving cells.

To this end, as shown at FIG. 7, the antenna of the invention also represented in an unrestricted way as the antenna shown at FIG. 4*c* is further provided with bias voltage lines adapted to feed each strips $LS_x$ and $US_y$ extending along the first X and the second Y reference directions. Corresponding lines are referred to as Lx and Ly at FIG. 7.

Each of these lines is connected to a programmable voltage generator referred to as VGX and VGY with each of these generators being adapted to generate and deliver corresponding voltage steps referred to as $\Delta V$ and $\Delta V'$.

Each of the generators is controlled thanks to a microprocessor μP which is adapted and equipped with a programmable memory designated as PROG. MEM.

In accordance with any program stored in a read only memory not shown at FIG. 7, each of the programmable generator is adapted to deliver as an example a voltage for each of the address of the transmitting-receiving cells, with this voltage being adapted to be varied within a given range of bias voltage values so as to adapt the central frequency of the generated microwave. The delivered voltage is applied to any pertinent variable capacity diode embodying each transmitting-receiving cell.

According to another mode of operation, the bias voltage is further varied in accordance with the address along the first X or the second Y reference directions of each of the transmitting-receiving cells. The microwave beam generated is thus deflected in azimuth and in elevation direction in accordance with the variation of this voltage along the first and the second reference direction.

With reference to the non limitative example of FIG. 7, the bias potential $\Delta V$ and the bias potential $\Delta V'$ may be switched alternatively from one to other of the first and second sub-arrays to make them inductive in turn to allow the generated microwave beam to be deflected of a given angle within a plane parallel to a first reference plane including the first X and third Z directions and a plane parallel to a second reference plane including the second Y and third Z directions.

The invention claimed is:

1. A steerable electronic microwave antenna, said antenna including at least:

a resonant cavity including a partially reflecting surface comprising an array of transmitting-receiving cells of said microwave, each transmitting-receiving cell of said array of transmitting-receiving cells being adapted for control in transmissivity and directivity;

a totally reflecting surface facing said partially reflecting surface, said partially and totally reflecting surface forming thus said resonant cavity;

a radiating element laid within said resonant cavity on the vicinity of said totally reflecting surface and adapted to generate said microwave;

means for controlling transmissivity and directivity of each transmitting-receiving cell and thus of said partially reflecting surface.

2. The antenna of claim 1, in which said partially reflecting surface includes at least:

an inductive array formed by a pattern of regular reflecting zones of said microwave separated by regular dielectric zones;

a capacitive array formed by a pattern of regular reflecting zones of said microwaves separated by regular dielectric zones, two adjacent reflecting zones of said capacitive array being electrically connected through a variable capacity diode, said reflecting and dielectric zones belonging to said inductive and capacitive array being superimposed so as to form said array of transmitting-receiving cells of said microwave.

3. The antenna of claim 1, wherein for a given distance separating said totally reflecting surface and the internal face of said partially reflecting surface, said separating distance forming thus a reference dimension of said resonant cavity verifies the relation:

$$h = \frac{\lambda}{4\pi}(\phi_{PRS} + \phi_r) \pm N\frac{\lambda}{2}$$

in which h: designates said reference dimension;

$\lambda$: designates the wavelength of said microwave;

N: designates the resonant order mode of said resonant cavity;

$\phi_{PRS}$: designates the phase shift introduced to said generated microwave directly reflected by said partially reflecting surface;

$\phi_R$: designates the phase shift introduced to said generated microwave by said totally reflecting surface directly transmitting said generated microwave.

4. The antenna of claim 2, wherein said radiating element generates a rectilinear polarized microwave the electric field component of which is substantially parallel to one direction of said inductive array along which said pattern of regular reflecting zones of said inductive array is arranged and the magnetic field component of which is substantially parallel to another direction of said capacitive array orthogonal to said one direction of said inductive array, along which said pattern of regular reflecting zones of said capacitive array is arranged, said one and another direction forming reference directions.

5. The antenna of claim 4, wherein said pattern of regular reflecting zones of said inductive array consists of a set of parallel rectangular metallic zones laid onto a dielectric substrate along a first reference direction and said pattern of regular reflecting zones of said capacitive array consists of a set of parallel rectangular metallic zones laid onto the opposite face of said dielectric substrate along a second reference direction orthogonal to said first reference direction.

6. The antenna of claim 2, wherein said radiating element generates a circular polarized microwave the electrical field component and the magnetic field component of which rotate in a plane which is substantially parallel to the pattern of regular reflecting zones of said inductive and capacitive array, the pattern of regular reflecting zones of said inductive array consisting of metallic inductive zones lying aligned along said first and second reference direction and the pattern of regular reflecting zones of said capacitive array consisting of corresponding metallic capacitive zones aligned along said first and second reference direction.

7. The antenna of claim 6, wherein each metallic inductive and capacitive zone consist of a square metallic patch, any one of said capacitive patches facing one said inductive patches facing one of said inductive patches, each metallic capacitive patch being connected to any adjacent square metallic capacitive patch through a variable capacity diode.

8. The antenna of claim 2, wherein said partially reflecting surface includes:

a first array forming a capacitive array including a pattern of regular reflecting zones each formed by a square patch, each of said square patches lying aligned and regularly spaced apart from each other to form successive columns and rows spread along said first and second reference direction, two successive square patches aligned along said first and second direction being electrically connected through a variable capacity diode to form an electrical closed circuit including four adjacent square patches spread along said first and second reference direction, two adjacent successive electrical closed circuit being thus electrically separated from each other along said first and second reference direction; and superimposed onto said first array along a third reference direction orthogonal to said first and second reference directions;

a second array adapted to form a selective inductive array along said first and or second reference direction, said second array including a first sub-array including a pattern of regular reflecting zones each formed by parallel metallic strips extending along said second reference direction over corresponding columns of square patches of said first array lying aligned along said same second reference direction, each parallel metallic strip of said first sub-array being electrically connected to one of two of the successive square patches underlying beneath each of said parallel metallic strips of said first array; and, superimposed onto said first sub-array along said third reference direction, a second sub-array including a pattern of regular reflecting zones each formed by parallel metallic strips extending along said first reference direction over corresponding rows of said square patches of said first array lying aligned along said same first reference direction and crossing thus said metallic strips of said first sub-array, each metallic strips of said second sub-array being electrically connected to one of two successive square patches underlying beneath each of said parallel metallic strips of said second sub-array and which are not electrically connected to said parallel metallic strips of said first array.

9. The antenna of claim 1, wherein said radiating element is frequency controlled, with the radiating frequency of said generated microwave being adjusted in a frequency range lying within plus and minus 15% of a central frequency.

10. The antenna of claim 2, wherein said partially reflecting surface includes a sandwiched printed circuit board, a first surface of said sandwiched printed circuit board, external to said resonant cavity, including said reflecting zones forming said inductive array and a second surface of said sandwiched printed circuit, internal to said resonant cavity, including said reflecting zones forming said capacitive array.

11. The antenna of claim 1, wherein said radiating element belongs to the group of radiating elements including patch antennae, dipoles, array of elementary antennae.

12. The antenna of claim 11, wherein said radiating element being an array of elementary antennae, each elementary antenna forming said array is spaced apart from any other elementary antenna of a distance greater than $$\frac{\lambda}{4},$$

where $\lambda$ designates the mean microwave wavelength generated by each of said elementary antenna.

13. The antenna of claim 1, wherein said means for controlling transmissivity and directivity of each transmitting-receiving cell and thus of said partially reflecting surface include means for generating and delivering an adjustable bias voltage adapted to control the variable impedance of each of the transmitting-receiving cells.

14. The antenna of claim 13, wherein said means for controlling include a bias circuit for parallel and/or individually controlling the bias potential delivered to each variable capacity diode included in one of said transmitting-receiving cell.

15. The antenna of claim 13, wherein said means for controlling transmissivity and directivity of each transmitting-receiving cell are programmable and adapted to generate and deliver at least one control bias voltage to each of the transmitting-receiving cell.

16. The antenna of claim 15, wherein said at least one control bias voltage is a unique bias voltage for each address of all the transmitting-receiving cells, said unique bias voltage being adapted to be varied within a given range of bias voltage values, so as to adapt the central frequency of said generated microwave.

17. The antenna of claim 15, wherein said unique bias voltage is further varied in accordance with the address along said first and/or second reference direction of each of the transmitting-receiving cells forming said partially reflecting surface, the microwave beam thus generated being thus deflected in azimuth and elevation direction in accordance with the variation of said bias voltage along said first and/or second reference direction.

18. The antenna of claim 8, wherein said bias potentials are switched alternatively from said one to said other of said first and second sub-arrays so as to allow the generated microwave beam to be deflected of a given angle within a plane parallel to a first reference plane including said first and third directions and a plane parallel to a second reference plane including said second and third direction.

* * * * *